United States Patent [19]

Tomalinas, Jr. et al.

[11] 4,108,517

[45] Aug. 22, 1978

[54] CHILD'S DESK WITH SLIDE-DOOR AND GUIDEWAY THEREFOR

[75] Inventors: William R. Tomalinas, Jr., Wapwallopen; Herbert S. Gurbst, Kingston, both of Pa.

[73] Assignee: Roth American, Inc., Wilkes-Barre, Pa.

[21] Appl. No.: 799,975

[22] Filed: May 24, 1977

[51] Int. Cl.[2] ..... E06B 9/14

[52] U.S. Cl. ..... 312/297; 312/257 R; 312/271

[58] Field of Search ..... 312/297, 257 R, 271

[56] References Cited

U.S. PATENT DOCUMENTS

| | | | |
|---|---|---|---|
| 882,207 | 3/1908 | McComb | 312/297 X |
| 1,259,167 | 3/1918 | Ticheli | 312/297 |
| 2,231,005 | 2/1941 | Gordon | 312/297 |
| 2,341,914 | 2/1944 | Fleischman | 312/297 X |
| 2,567,536 | 9/1951 | Wolters et al. | 312/297 X |
| 3,484,573 | 12/1969 | Tingley | 312/297 |
| 3,837,041 | 9/1974 | Modert | 312/297 X |

*Primary Examiner*—Paul R. Gilliam
*Assistant Examiner*—Victor N. Sakran
*Attorney, Agent, or Firm*—Burns, Doane, Swecker & Mathis

[57] ABSTRACT

The disclosure relates to a desk with a roll-top door, slidably moveable along a pair of parallel guideways. The door includes a plurality of slats articulated to one another by a flexible backing sheet. Each of the guideways is formed with walls defining two slots: one for fixedly engaging an edge of the desk to which the guideway is mounted; the other slot for slidably receiving an edge of the door. The guideways are made of flexible plastic and are adapted to be bent and attached to the desk in a shape conforming to the desired arcuate path along which the roll-top door is to slide.

2 Claims, 7 Drawing Figures

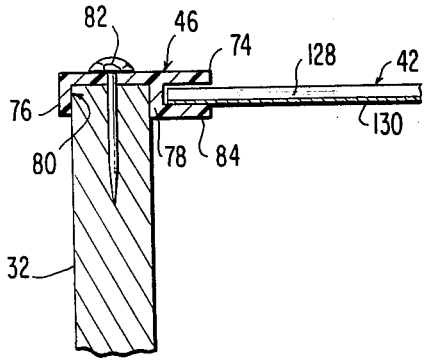
FIG. 3
FIG. 4
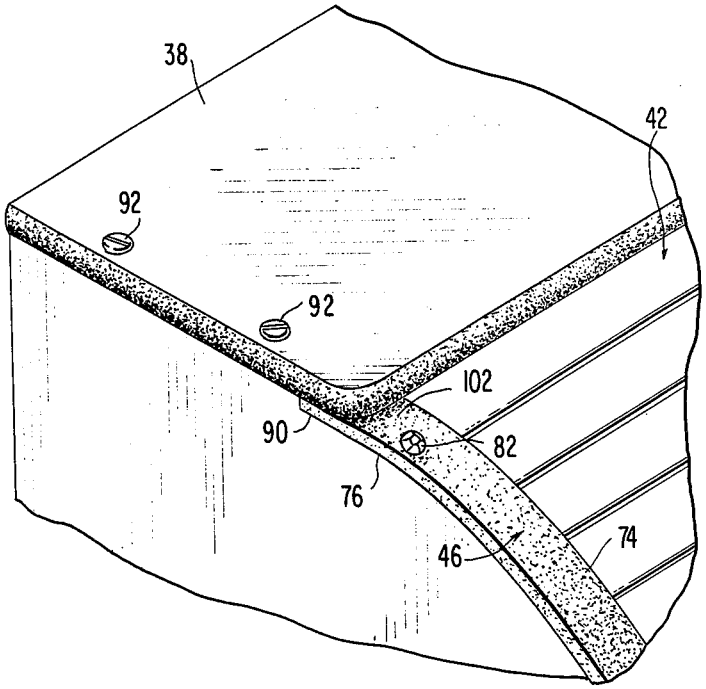
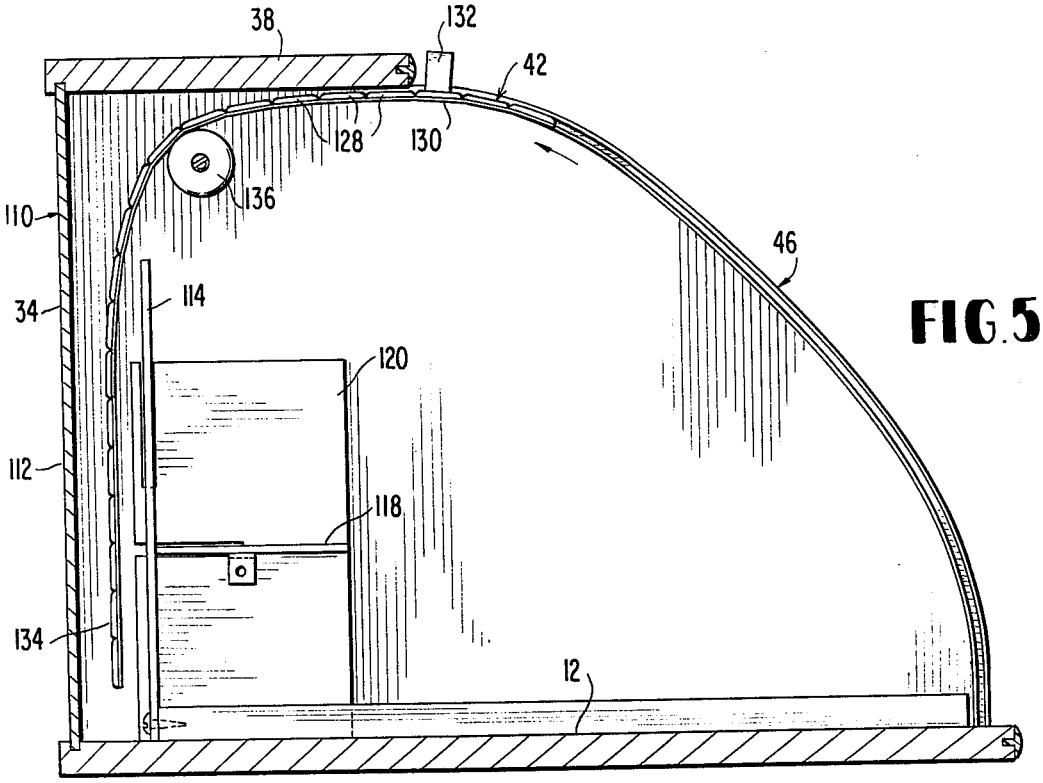
FIG. 5

CHILD'S DESK WITH SLIDE-DOOR AND GUIDEWAY THEREFOR

BACKGROUND OF THE INVENTION

The subject invention relates to a desk with a slide-door and guideway therefor. More particularly, this invention relates to a toy roll-top desk for a child.

Full sized roll-top desks have long been used by adults. Such desks are popular, in part, because they permit the desk surface to be quickly and conveniently covered to provide an outwardly neat appearance. In addition, the upper sides surrounding the desk surface provide some degree of privacy for the user and afford a convenient location for pigeonholes for organizing desk materials.

These features of the roll-top desk are likewise of value if incorporated in a child's desk. Specifically, since children are known to keep desk surfaces in an untidy condition, it is advantageous to provide a child's desk with a slide-door for selectively covering the desk surface. Moreover, the privacy afforded by the side walls of a roll-top desk may improve the child's work habits and concentration. Finally, the provision of easily accessible pigeonholes above the work surface of the desk may encourage the child to organize his papers, writing implements and other desk materials.

Conventional, full-sized roll-top desks are illustrated, for example, in U.S. Pat. No. 242,436; and U.S. Design Pat. Nos. 18227; 18176; and 87697. Such desks are of massive construction having carefully shaped and fitted wooden components. The desks include a plurality of drawers, ornamental moldings, and slatted roll-top doors, slidably moveable along wooden tracks provided on the upper desk sides. These features contribute substantially to the typically great cost of such desks. For this reason, mere reduction in the size of such desks would not make them sufficiently inexpensive as to be suitable for use as toy desks for children. Moreover, the scaling-down of the slotted door and wooden tracks may make construction difficult and weaken necessary components to such an extent that they would be easily damaged or broken by the rough handling typically given a desk by young children.

Accordingly, it is an object of the present invention to provide a novel, inexpensive and easily fabricated roll-top desk for a child.

Another object of the present invention is to provide a novel, inexpensive roll-top desk having a durable slide-door and guideway.

A major cost of the provision of furniture items is the cost of transporting the furniture to the customer. Packing and transporting of furniture is facilitated if the furniture can be easily, partially disassembled. Where the item of furniture includes a slide-door, as, for example, in a roll-top desk, the versatility of the design is increased if the working surface, casing, and slide-door assembly is constructed independently of a pedestal therefor.

Accordingly, it is another object of the present invention to provide a novel working surface, casing and slide-door assembly adapted for easy attachment to a pedestal to provide a roll-top desk.

Such slide-doors and guideways as have been used in conventional desks, cabinets etc., employ rigid, slotted guideways. For example, a desk disclosed in U.S. Pat. No. 3,294,465 to Blodee et al, includes a rigid, slotted guideway for a slide-door, the slot being coated with plastic. U.S. Pat. No. 2,070,924 to Derman shows straight, rigid frame strips with straight slots for engaging the slide-door of a cabinet and walls of the cabinet. The slide-door is constructed of thin, independent strips of cardboard or wood attached to one another by a sheet of canvas or other fabric.

Prior art assemblies of this type with rigid guideways have several disadvantages. First, curved rigid guideways, of a type required in a roll-top desk, are difficult to form. Second, where the slide-door is of relatively light construction, the door may be easily damaged by rough handling when its edges are constrained to follow a rigid, arcuate guideway.

Accordingly, it is a further object of the present invention to provide a novel, inexpensive desk with a slide-door of relatively light construction for easy handling which is slidable along an arcuate guideway.

These and other objects and features of the present invention will become apparent from the following description when read in conjunction with the appended drawings.

SUMMARY OF PREFERRED EMBODIMENTS

In preferred forms of the present invention, a desk with slide-door for closing an access opening to a horizontal work surface includes a supporting base for supporting the work surface member, and providing a plurality of compartments below the work surface. A rear wall or casing member rising from the work surface has pigeonholes formed therein. Parallel side members, attached to the rear casing member and disposed perpendicularly to the work surface, have symetrical, arcuate edge portions. The casing member and the side members define an access opening to the horizontal work surface. The access opening to the horizontal work surface is closeable by means of a slide-door comprised of a plurality of elongated slats which are disposed so that their longitudinal edges are parallel and abutted. The slats may be articulated to one another by a flexible backing sheet attached to a longitudinal face of each of the slats. The desk is provided with elongated guideway members disposed along the arcuate edge portions of the side members and fastened to the side members by a plurality of fasteners that are inserted at spaced intervals through the guideway members and the side members.

The preferred guideway members are plastic members formed with an elongated portion and an elongated skirt portion depending from the base portion. An elongated wall portion depends from the base portion and, together with the base portion and skirt portion, defines a slot which engages the arcuate edge portion of the side member. A second elongated wall portion, extending from the first wall portion and generally parallel to the base portion defines, together with the first wall portion and the base portion, a slot for receiving and slidably engaging the ends of the slats of the slide-door.

THE DRAWINGS

FIG. 3 is a cross-sectional view of a guideway member, taken along line 3—3 of FIG. 2.

FIG. 4 is a pictorial detail of the guideway member and side wall member of the embodiment of FIGS. 1 and 2.

FIG. 5 is a cross-sectional view showing a guideway member and slide-door combination of the present invention without a standard desk base.

DETAILED DESCRIPTION

Figure 1:
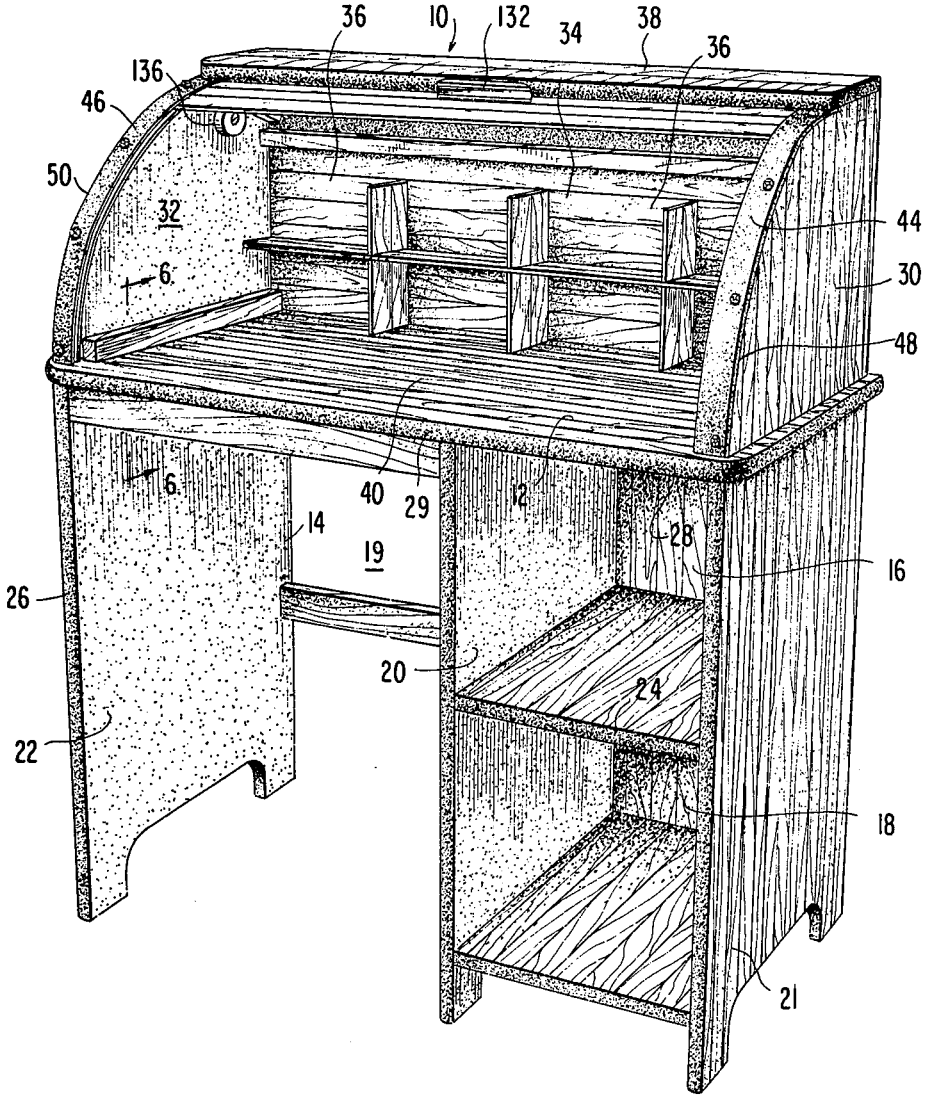
FIG. 1 is a pictorial view of a child's desk with its slide-door opened.
Figure 2:
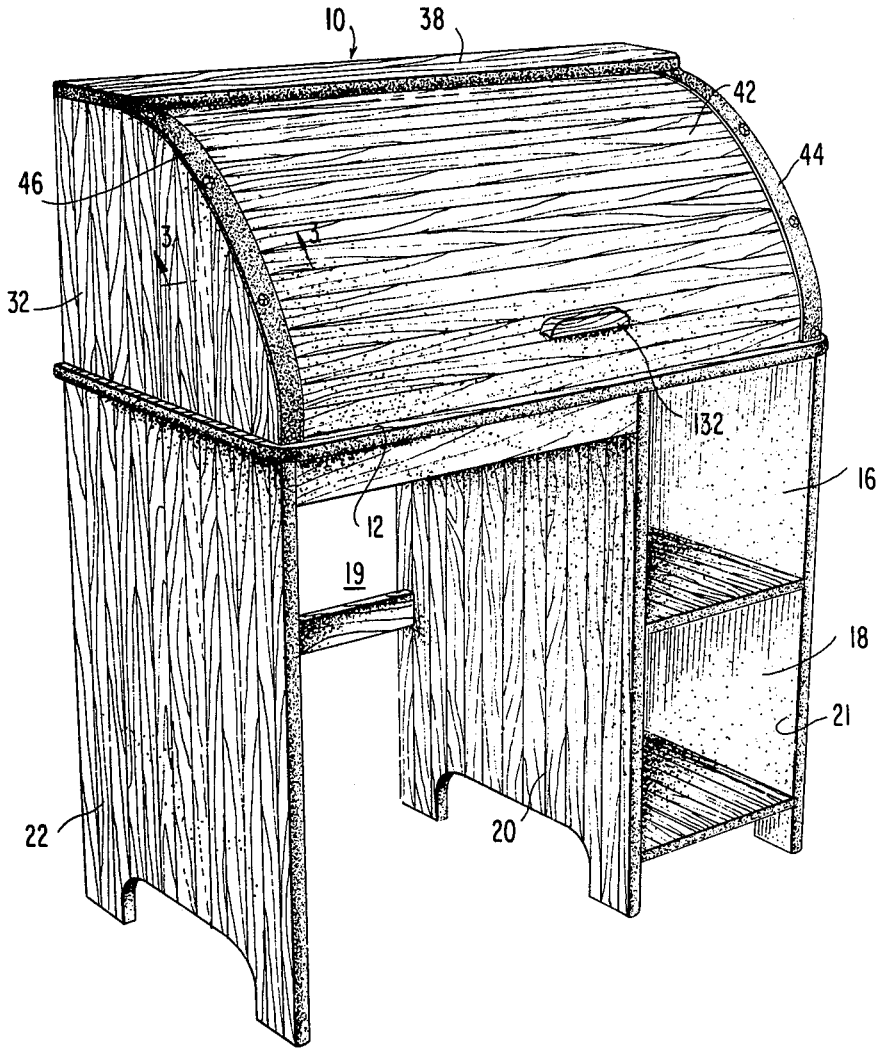
FIG. 2 is a pictorial view of a child's desk with its slide-door closed.

Referring first to FIGS. 1 and 2, a child's desk with slide-door and guideway is designated generally by the numeral 10. In FIG. 1 the desk is shown with the slide-door in an open position, while in FIG. 2 the desk is shown with its slide-door in a closed position.

The desk includes a horizontal work surface member 12 and a supporting base 14. The supporting base is formed with compartments. Pedestal members 20, 21 and 22 support the work surface member. Two of these pedestal members 20 and 22 bound an open volume 19 within the supporting base member 14, which is adapted to receive a properly dimensioned desk chair and which provides sufficient clearance for a child to sit on the chair and place his legs at least partially beneath the horizontal working surface member 12.

The horizontal working surface member 12 is surrounded on three sides by wall members 30, 32 and 34. The rear wall member 34 is configured as a casing member with a plurality of pigeonholes 36 suitably formed in association therewith. The casing member 34 rises perpendicularly from the surface of the horizontal working surface member 12. The side wall members 30 and 32 are disposed perpendicularly to the horizontal working surface and perpendicularly to the rear wall or casing member 34. An upper horizontal shelf member 38 is disposed on upper edges of the rear wall 34 and the side wall members 30 and 32. The walls 30, 32 and 34 define an access opening 40 to the horizontal work surface.

In a preferred embodiment the desk base, the horizontal working surface, and the shelf member are made of particle board with a butcher block finish of veneer. The pigeonholes may be formed from pieces of masonite with a butcher block finish of veneer. Exposed edges of the desk members made of particle board, such as edges 24, 26 and 28 may be faced with a plastic molding to cover the roughened wood edge.

The access opening 40 to the horizontal work surface is closed by a slide-door 42, slidably moveable along elongated guideway members 44 and 46. The guideway members 44 and 46 are disposed along symetrical arcuate edge portions 48 and 50 of the side wall members 30 and 32, respectively. In a perferred embodiment, the guideway members 44 and 46 are attached to the side walls 30 and 32 by suitable fasteners such as furniture nails inserted through the guideway members into the side wall members. Advantageously, the elongated guideway members 44 and 46 may be formed from flexible plastic channel members which may be bent to conform to the shape of the arcuate edge portions 48 and 50 and then fastened thereto. The structure of the elongated guideway members 44 and 46 is described in greater detail in connection with FIG. 3, which is a cross-sectional view taken along lines 3—3 of FIG. 2.

Referring now to FIG. 3, the elongated guideway member 46 is shown in cross-section, attached to the desk side wall member 32. The elongated guideway member includes a flexible, flat base portion 74 from which an outer skirt portion 76 depends. Both the base portion and the skirt portion are elongated in the direction of the elongation of the guideway member, i.e. in a direction perpendicular to the plane of the Figure. A first elongated wall portion 78 together with the base portion 74 and the skirt portion 76 define a downwardly opening slot or channel 80 adapted for engaging an arcuate edge portion of the side wall member 72. The guideway member 46 is held in position on the arcuate edge portion of the side member 32 by means of a fastener such as nail 82 inserted through the elongated guideway member 46 into the side wall member 32.

A second wall portion 84 extends from the first wall portion 78 in a direction generally parallel to the base portion 74. The second wall portion is elongated in the direction of the elongation of the guideway member. The first wall portion 78 and the second wall portion 84, along with the base member 74 together define a laterally inwardly facing slot or channel for receiving a slidably engaging the slide-door 42.

Advantageously, the elongated guideway member 46 may be formed from flexible plastic adapted to be bent to conform to the shape of the arcuate edge portion of the side wall member 32. It will be noted that the guideway member not only provides a slot for guiding the slide-door 86, but provides an attractive molding for facing the arcuate edge portion of the side wall 32.

FIG. 4 is a pictorial detail of the child's desk of FIGS. 1 and 2, wherein the attachment of the shelf member 38 and an upper end 90 of the guideway member 46 are shown. The flexible guideway member 46 is disposed on the arcuate edge portion 50 of the desk side wall 32. The side wall 32 may be contacted by the base portion 74 and the skirt portion 76 of the elongated guideway member 46. During assembly the end portion 100 of the elongated guideway member 46 may be sandwiched between the side wall member 32 and a top shelf member 38. The top shelf member is attached to the side wall member 32 by fasteners 92. This construction aids in retaining the elongated guideway member 46 in position and provides a smooth transition between the guideway member and the upper shelf member 38 to reduce the possibility of the slide-door 42 catching on the shelf member or the end of the guideway.

FIG. 5 is a cross-sectional view showing the upper component portion 110 of the desk of FIGS. 1 and 2, which is adapted for attachment to the desk base member. Alternatively, the structure of FIG. 5 may be employed as a roll-top cabinet, without the provision of a special supporting base member.

The rear casing member 34 of the structure, including a rear wall member 112 and a front member 114, rises perpendicularly from the horizontal work surface member 12. Advantageously, the rear wall member may be attached to the desk by insertion in slots in facing surfaces of the side wall members. The front member 114 includes horizontal and vertical members 118 and 120 which define a plurality of pigeonholes. The structure and assembly of the front member is described in greater detail in connection with FIG. 7. The top shelf member 38 is attached to the rear wall member 112 and to the side wall members.

The structure of FIG. 5 employs a guideway member and slide-door embodiment of the present invention. The access opening to the horizontal work surface member 12 is closed by the slide-door 42 slidably moveable along the elongated guideway member 46. The slide-door 42 may include chamfered elongated slats 128 with their longitudinal axes (perpendicular to the plane of the figure) oriented parallel to one another. The slats 128 are articulated to one another by attachment to a flexible backing sheet 130. Advantageously, the flexible backing sheet 130 may comprise a sheet of heavy paper reinforced with strips of fabric.

In operation, the slide-door may be moved to uncover the access opening to the horizontal work surface member by manually grasping a handle 132 and slidably moving the slide-door along the guideway member 46 in the direction of the arrow in FIG. 5. As the slide-door is opened, a leading portion 134 of the slide-door advances downward between the rear wall member 112 and the front wall member 114 of the rear casing member 34. Movement of the slide-door along this path is facilitated by a pair of guide rollers such as roller 136, each of the guide rollers being rotatably mounted on screws inserted into one of the side wall members.

Figure 6:
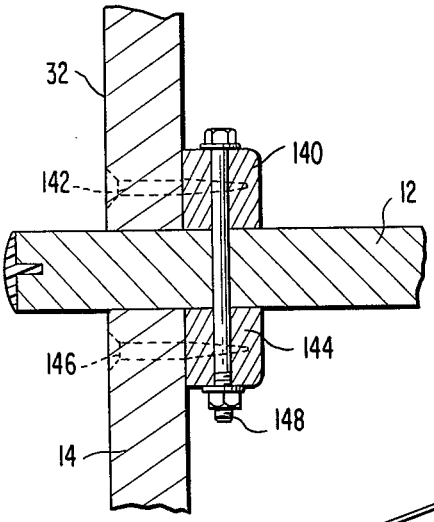
FIG. 6 is a cross sectional view of a side wall member, a supporting base member, and working surface member taken along line 6—6 of FIG. 1.

The upper component 110 of the desk is adapted for attachment to a supporting base member in the manner shown in FIG. 6. A first attachment strip 140 is secured to the side wall member 32 by means of screws such as screw 142. A corresponding second attachment strip 144 is secured to the pedestal member 14 by means of screws such as screw 146. The desk may then be assembled by sandwiching the horizontal working surface 12 between the attachment strips 140 and 144, and by inserting bolts, such as bolt 148, through the working surface and the attachment strips.

Figure 7:
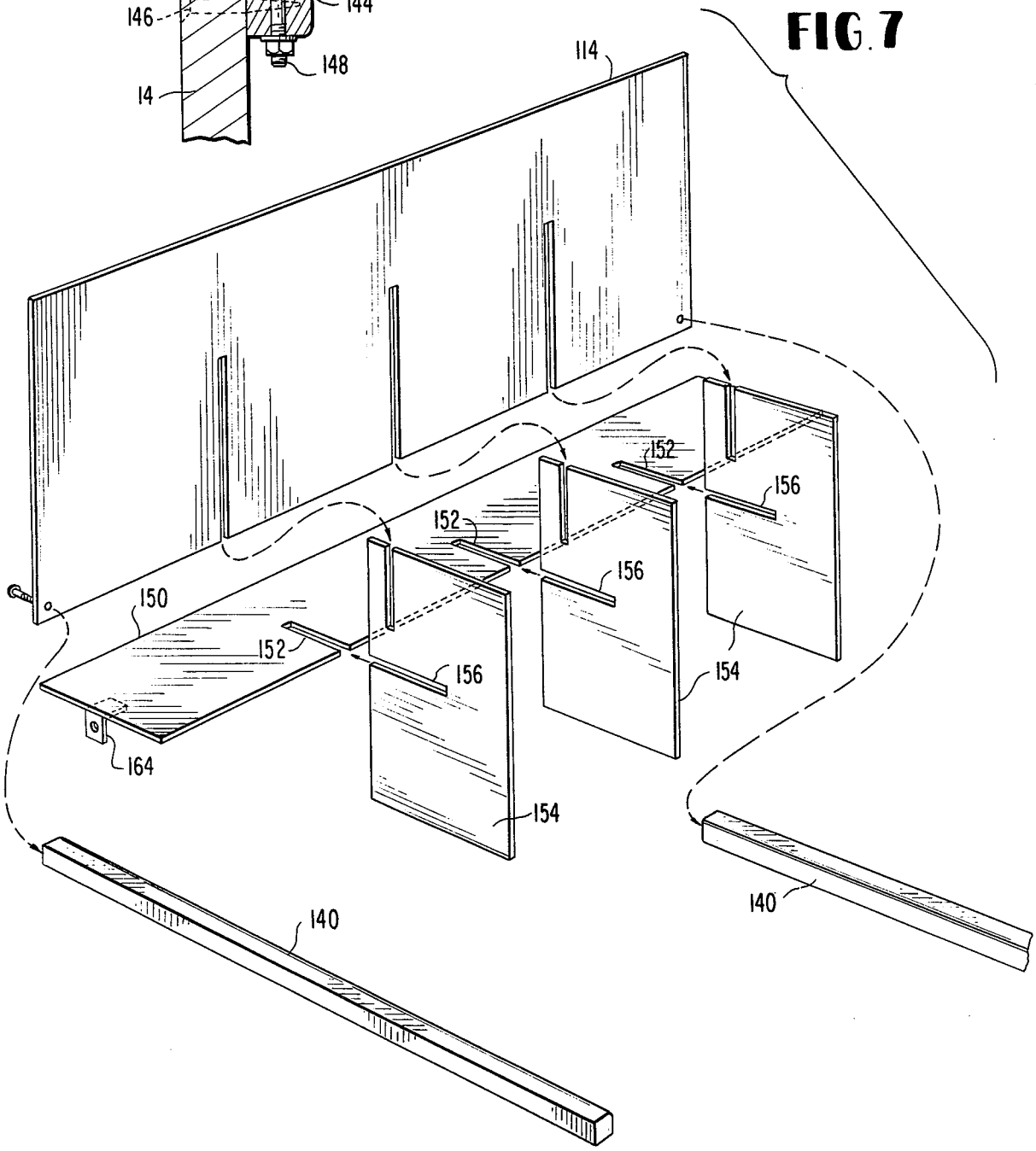
FIG. 7 is an exploded pictorial view of the pigeonhole assembly of a casing member of an embodiment of the present invention.

Referring now to FIG. 7, the structure and assembly of the wall member 114 and pigeonholes is shown. A horizontal shelf member 150, formed with laterally opening slots 152, is dimensioned and configured for interlocking engagement with a plurality of vertical partition members 154 with laterally opening slots 156. Once the shelf member 150 and partition members 154 are engaged, the rear wall member 114 may be engaged in position by mating downwardly opening slots thereof 158, with upwardly opening slots 160, formed in the partition members 154. The rear wall and pigeonholes may be secured in position in the desk by a screw 162 inserted through the rear wall member 114 into the attachment strip 140. In addition the horizontal shelf member may be attached to the side wall members (not shown) by means of fasteners and angle brackets 164.

The principles, preferred embodiments and modes of operation of the present invention have been described in the foregoing specification. The invention which is intended to be protected is not, to be construed as limited to the particular forms disclosed, since these are to be regarded as illustrative rather than restrictive. Variations and changes may be made by those skilled in the art without departing from the spirit and scope of the present invention.

What is claimed is:

1. A desk with a slide-door for closing an access opening to a horizontal work surface member comprising:

a horizontal work surface member;

a supporting base for supporting said work surface member providing a plurality of compartments below said work surface member;

a rear casing member disposed above the work surface member and having pigeonholes therein;

parallel side members attached to said rear casing member and disposed perpendicularly to the horizontal work surface member, said side members having symmetrical arcuate edge portions, said casing member and said side members defining an access opening to said horizontal work surface;

a first attachment strip secured to one of said parallel side members;

a second attachment strip secured to a vertical wall of said supporting base, said horizontal work surface member being sandwiched between said attachment strips and attached thereto by bolts inserted through the attachment strips and the working surface member;

a slide-door for closing the access opening to the horizontal work surface member including a plurality of elongated slats, disposed so that their longitudinal edges are parallel, said slats being articulated to one another by a flexible backing sheet attached to a longitudinal face of each of the slats; and, elongated guideway members disposed along the arcuate edge portions of the side members and fastened to the side members by a plurality of fasteners, inserted at spaced intervals through said guideway members into said side members, said guideway members each consisting of:

a base portion;

an elongated skirt portion depending from said base portion;

a first elongated wall portion depending from said base portion intermediate its edges, which, together with said base portion and said skirt portion defines a first, generally U-shaped slot which engages the arcuate edge portion of a side member to serve as an edge molding for the side member, while said base portion remains in a generally perpendicular orientation with respect to said side member; and, a second elongated wall portion extending from said first wall portion, generally parallel to said base portion, which, together with said first wall portion and said base portion defines a second, laterally opening U-shaped slot for receiving and slidably engaging ends of said slats wherein said guideway members are formed of flexible plastic and wherein said guideway members are attached to the arcuate edge portions of the side members with fasteners inserted at intervals through the base portions of the plastic guideway members into the arcuate edge portions so that the guideway members conform to the shapes of the arcuate edge portions of the side members.

2. The apparatus of claim 1 further comprising a shelf member attached to upper horizontal edges of said parallel side members, the uppermost ends of each of said guideway member being sandwiched between said shelf members and the parallel side member to which the guideway member is attached; whereby said guideway members are retained in position by said shelf member to facilitate smooth movement of said slide-door beyond the uppermost ends of said guideway members.

* * * * *